US005256119A

United States Patent [19]

Tudor

[11] Patent Number: 5,256,119

[45] Date of Patent: Oct. 26, 1993

[54] LEG EXTENSION EXERCISE DEVICE

[76] Inventor: E. Jess Tudor, 112 Henry Ct., Tracy, Calif. 95376

[21] Appl. No.: 700,485

[22] Filed: May 15, 1991

[51] Int. Cl.[5] ..... A63B 71/00

[52] U.S. Cl. ..... 482/74; 602/23; 128/882

[58] Field of Search ..... 272/70; 128/25 R, 80 G, 128/80 F, 25 B, 25 C; 273/54 B; 482/14, 15, 74, 79; 602/4, 23, 24, 25, 26, 28, 29

[56] References Cited

U.S. PATENT DOCUMENTS 1,548,711 8/1925 Cooper ..... 128/80 G
4,252,112 2/1981 Joyce ..... 128/25 R
4,294,238 10/1981 Woodford ..... 482/79
4,337,938 7/1982 Rodriquez ..... 482/74
4,961,573 10/1990 Wehrell ..... 482/74

*Primary Examiner*—Stephen R. Crow
*Attorney, Agent, or Firm*—Bielen, Peterson & Lampe

[57] ABSTRACT

An exercise harness for restricting hyperextension of a wearer's legs when worn with the wearer in an upright position, the harness having a waist belt with depending leg straps located against the back of the wearer's legs and connected to foot stirrups, the straps having knee bands to retain the straps against the legs and adjustment structure to adjust the length of the straps and the resulting degree of hyperextension of the wearer's legs.

8 Claims, 2 Drawing Sheets

LEG EXTENSION EXERCISE DEVICE

BACKGROUND OF THE INVENTION

This invention relates to a whole body exercise device that provides a dynamic means of exercising, utilizing an inexpensive harness that restricts the extension of the leg at the knee. The leg extension exercise device is designed to be utilized either in a formal exercise setting or uniquely can be worn under the user's garments during the user's day-to-day routine. Unlike popular isometric exercises which can also be adapted into a regimen outside a conventional training arena, the exercise device of this invention provides for dynamic rather than static routines. The exercise routines are incorporated into normal, walking from place-to-place on the job or at home while doing the tasks of normal daily life.

Furthermore, unlike exercise machines which are specifically directed to leg extension exercises, the apparatus simultaneously exercises a variety of muscle structures as well as those involved in extending or flexing the leg. For example, in addition to exercising virtually all of the leg muscles, the apparatus of this invention when utilized will exercise the abdomen and back muscles and improve the user's posture as well as his strength and stamina.

The primary object of this invention is to provide an effective leg harness that can be worn to limit hyperextension of the leg at the knee such that the user will walk or stand with his legs slightly flexed. In this position, the user depends in substantial part upon his leg muscles as opposed to the locked bone structure of his skeleton to support his body. The cooperative effect of numerous muscle structures acting to support the body, particularly upon movement during walking, provides an active form for leg and torso conditioning for both non-athletes and athletes. By simple adjustment of the straps comprising the harness, the apparatus can alter the level of difficultly of conditioning and provide both a mild conditioning or a rigorous training.

The apparatus also has application for therapeutic conditioning that is useful after knee operations or knee injuries that can be implemented in a program of recuperation or rehabilitation. The harness is inexpensively manufactured and easily engaged on the wearer such that the wearer can make his own adjustment and devise his own routine according to his ability and his desired level of difficultly.

SUMMARY OF THE INVENTION

The leg extension exercise device of this invention comprises a harness apparatus that is constructed from an interconnected series of nylon straps. The exercise harness includes an encircling waist belt with two depending straps that extend down the back of the wearer's legs to his ankles and connect to foot stirrups that engage the wearer's feet. Around each of the user's legs above each knee is wrapped a restraining band to maintain the leg members against the leg during use. By lengthening or shorting the elongated leg members the ability to extend the leg when the user is in an upright position can be restricted.

The harness provides a simple way to exercise and is especially beneficial to sport enthusiasts who challenge their own performance limitations. By increasing the difficulty factor the wearer can dramatically increase leg strength in just minutes a day. Together with a suitable weight control program, the leg extension device provides a convenient exercise regimen that is essential in helping to maintain and increase muscle composition and loss of fat. The leg extension harness can be worn around the house, at work, during after-dinner walks, or anytime where there may be periodic ambulatory movement. The wearer can be conveniently released from the restriction of hyperextension of the legs by simple detachment of the leg members from the foot stirrup. In a normal office work situation, the wearer need not even detach the apparatus while seated as the harness places no restraint on the leg during flexion. The harness can be conveniently be worn under outer garments to conceal the device during use. These and other features of the invention will be considered further in the detailed description of the preferred embodiment that follows hereafter.

DETAILED DESCRIPTION OF THE PREFERRED EMBODIMENTS

Figure 1:
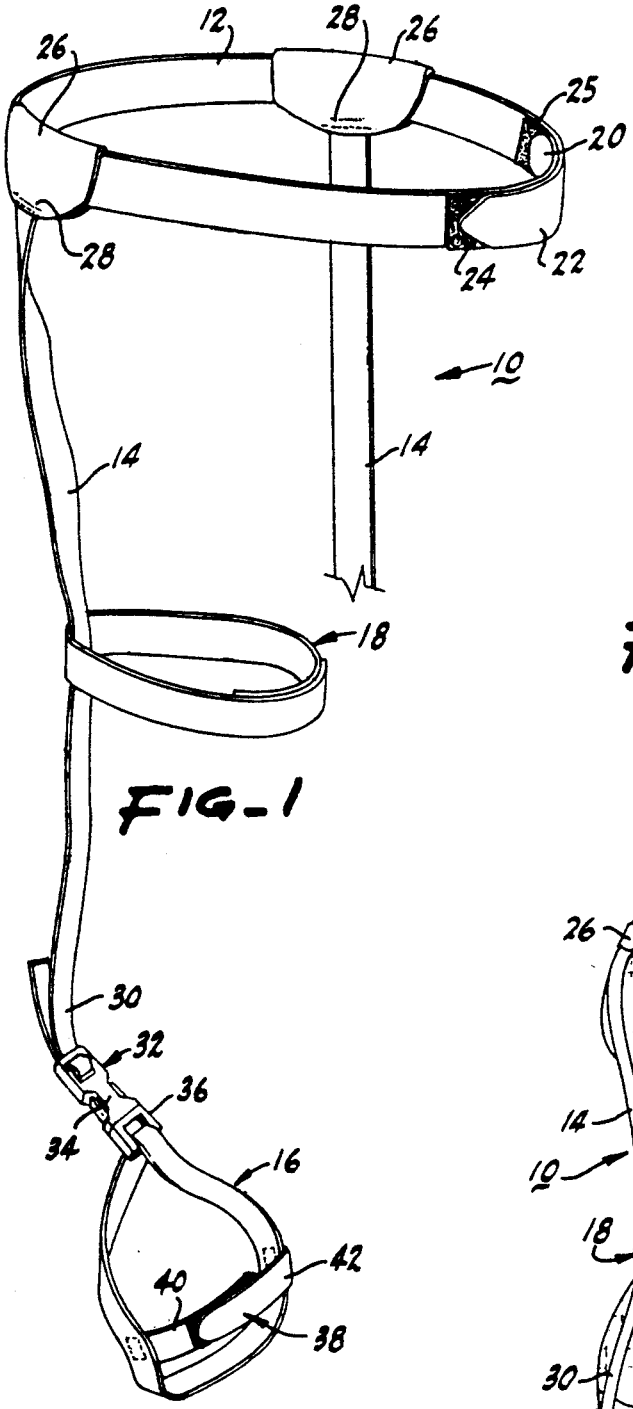
FIG. 1—is a perspective view, partially broken away, of a leg extension exercise device of this invention.
Figure 2:
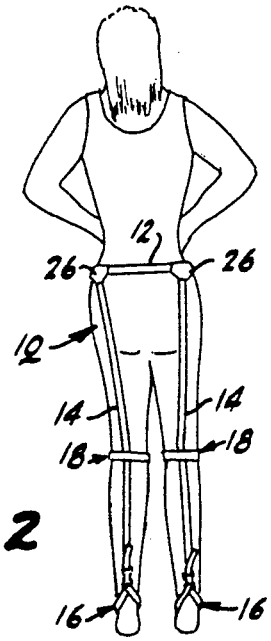
FIG. 2—is a back evaluational view of the exercise device worn by a user in a standing position.

Referring now to FIG. 1, the leg extension exercise device of this invention comprises a harness unit 10 that includes a waist belt 12 and a pair of depending leg straps 14. The leg straps 14 of the harness unit connect to foot stirrups 16 and include a pair knee bands 18 (one shown in FIG. 1.) that are designed to encircle the wearer's leg above the knee and maintain the leg straps 14 flat against the back of the wearer's legs.

Figure 3:
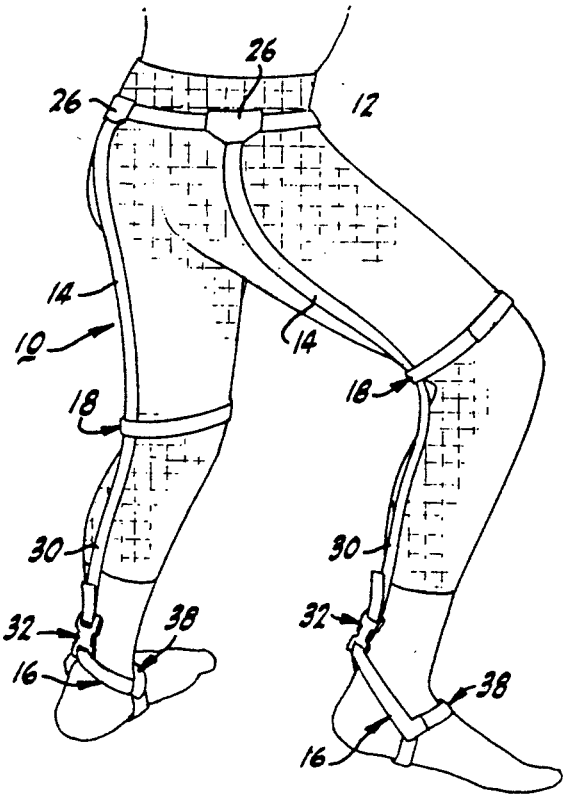
FIG. 3—is a partial view of the wearer of FIG. 1 in an ambulatory movement.

The waist belt 12, the leg straps 14, the stirrups 16, and the knee bands 18 are preferably fabricated from a one inch wide woven nylon strap material that is high in strength and relatively non-stretchable. The waist belt 12 is constructed with ends 20 and 22 having a typical nap segment 24 and a hook segment 25 of a VELCRO® type for ease of adjustability. The depending leg straps 14 are connected to the waist belt 12 at fold-over members 26 which are preferably fabricated from suede leather to provide the dual function of comfort and stability to the leg straps and waist belt during use. The fold-over members 26 are appropriately stitched with high-strength thread stitching 28. The distal ends 30 of the leg straps 14 as shown in FIGS. 1 and 3 are looped through a plastic connector clip 32 having a receiving member 34 and a detachable prong member 36, which in turn is looped through the foot stirrup 16. The clip 32 is of a conventional type commonly found in light weight camping and athletic gear and enables the leg straps to be easily detached from the foot stirrups 16.

Figure 4:
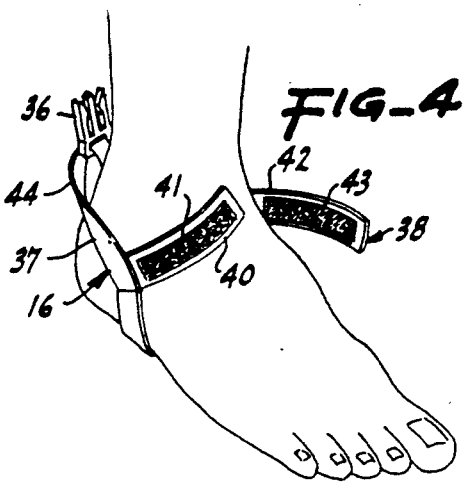
FIG. 4—is a perspective view of the foot stirrup of the harness unit.

The foot stirrup comprises to a loop member 37 that hooks under the sole of the foot and connects at the back of the ankle to the prong member 36 of the clip 32. Connected to each loop member is a separable strap member 38 having a nap segment 40 with nap 41 and a segment 42 with hooks 43 as shown in FIG. 4 to enable the stirrup to be easily engaged or disengaged from the wearer's foot. The segments 40 and 42 of the strap member are positioned over the top of the foot to anchor the leg straps as shown if FIG. 3.

Figure 5:
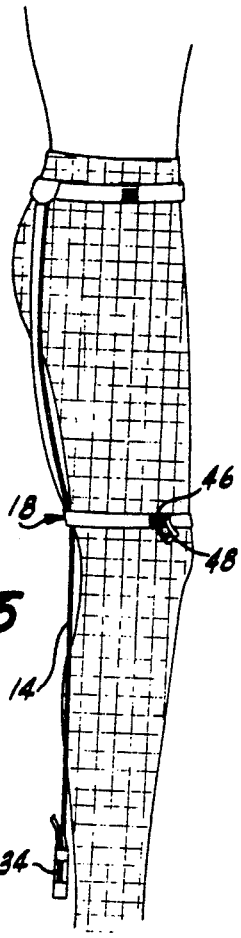
FIG. 5—is a side elevational view of the upper portion of the harness unit.

With the leg straps 14 detached from the stirrups 16 the wearer can stand upright with the leg in a hyperextended position as shown in FIGS. 4 and 5. To maintain the leg straps 14 in position along the back of the legs, the harness unit 10 includes the knee bands 18 which are similarly adjustable by a nap segment 46 and a pile segment 48 shown in the peeled back segment of FIG. 5. During use, the knee bands 18 should be firmly adjusted around the leg just above the patella with the end 22 of the leg straps adjusted in the end clip 32 to a particular length such that the wearer has the desired limited extension of his legs. The degree of this adjustment should be made according to the level of exercise desired by the wearer when moving or standing in a flexed leg position. Adjustment can easily be made when seated with the legs flexed to loosen the straps.

Figure 6:
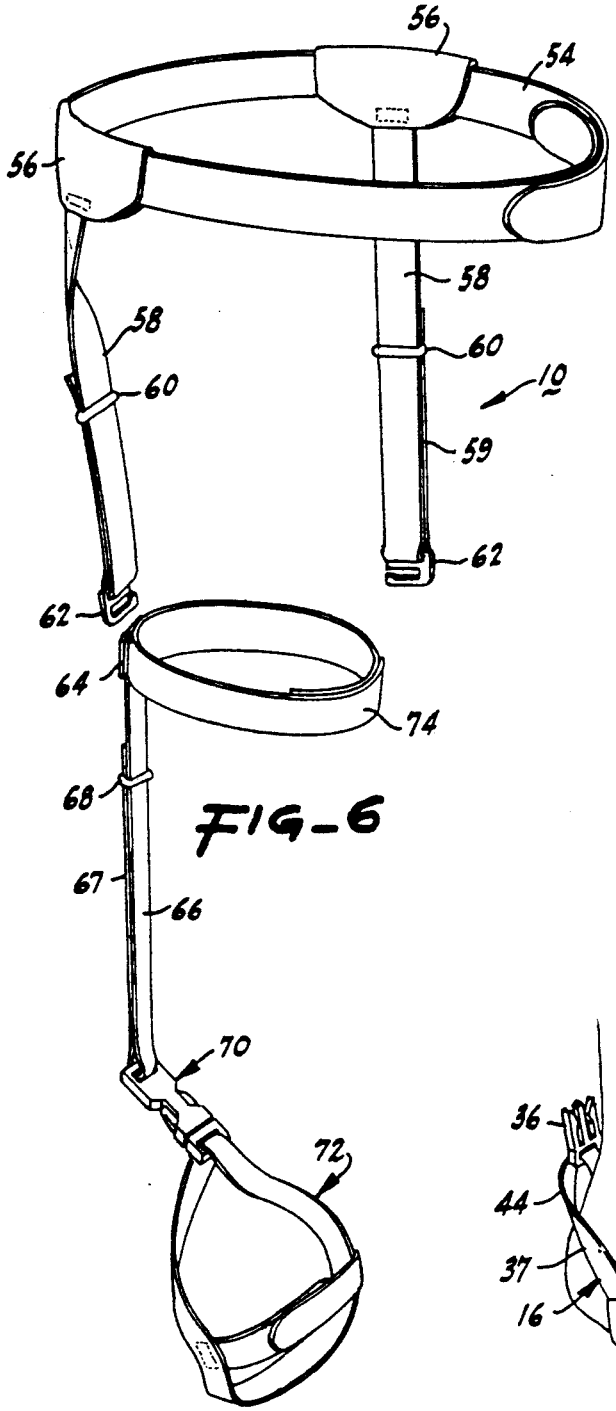
FIG. 6—is a perspective view of an alternate embodiment of the leg extension exercise device.

As shown in FIG. 6, the harness unit 10 can have an alternate construction that enables the leg extension exercise device to be utilized without a waist belt or upper segments of the leg straps. As shown in FIG. 6, a waist belt 54 has fold-over members 56 which connect to leg strap segments 58, with an adjustment loop 59 that engages a belt ring 60 and end hooks 62. The end hooks 62 are engageable with a connection loop 64 on the upper end of the leg strap 66 that aligns with the lower leg of the wearer. The leg straps 66 each have a knee band 74 that is adjustable as previously described. The leg strap segment 66 has an adjustment loop 67 retained by a strap or belt ring 68. The loop 67 connects to a plastic clip member 70 in a manner previously disclosed. The clip member 70 also connects a detachable foot stirrup 72 using the same construction as the stirrup shown in FIG. 4.

When the upper segment of the leg strap 58 is connected to the lower segment 66 the harness unit operates in the same manner as the unit described with the FIGS. 1–5. The waist belt 12 assists in limiting the leg extension by providing the ultimate anchor for the leg straps from the foot stirrup. However, it is also useful to utilize the lower leg strap 66 with the knee bands 74 without the upper members. In this manner the knee bands 74 provide the necessary anchorage to the leg strap limiting extension on adjustment of the length between the femur and foot. The knee bands 74 are required to be adjusted to be somewhat tighter than when wearing the waist band and certain individuals may not find this arrangement as satisfactory as the complete unit. However, in certain situations convenience may outweigh certain loss in performance.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An exercise harness for restricting hyperextension of a wearer's legs when worn by a wearer in an upright position, the harness comprising:

a waist belt having adjustment means, the belt being adapted to encircle a wearer's waist;

a pair of substantially non-stretchable leg straps, each strap having a first end connected to the waist belt with the strap depending therefrom and positioned on the waisted belt to depend against the back of a wearer's leg with a second end locatable proximate a wearer's ankle;

retaining means to retain each of depending leg straps against the back of the wearer's leg;

a pair of foot stirrups each engageable with a foot of the wearer with the second end of each leg strap being connectable to a foot stirrup, wherein the strap has a length preventing hyperextension of the wearer's legs; and adjustment means for adjusting the effective connecting length of the leg straps wherein the degree of restricting hyperextension of the wearer's legs when standing or walking is varied.

2. The exercise harness of claim 1 wherein the retaining means comprises a knee band engaging the leg straps above the back of the wearer's knees.

3. The exercise harness of claim 1 wherein the second ends of the leg straps each include a disengageable connection means connecting the leg straps to the foot stirrups.

4. The exercise harness of claim 3 wherein the connection means comprises a clip having a receiving member and a prong member, one member connected to the stirrup and one member connected to the second end of the leg strap.

5. The exercise harness of claim 1 wherein the leg straps each are comprised of two segments, an upper first segment connected to the waist belt and to the retaining means and a lower second segment connected to the retaining means and the foot stirrup.

6. The exercise harness of claim 5 wherein the first segment is detachable from the retaining means for use of the harness without the waist belt and upper segments of the leg straps.

7. The exercise harness of claim 1 wherein the harness is fabricated from woven nylon strap material.

8. An exercise harness for restricting hyperextension of a wearer's legs when worn by a wearer in an upright position the harness comprising:

a pair of knee bands each formed of an adjustable strap wrapped around a wearer's leg above the knee;

a pair of foot stirrups each engagable with a wearer's foot;

a pair of substantially non-stretchable leg straps, each strap having a first end connected to knee band and a second end connected to the stirrup the straps having a length that prevents full hyperextension of the wearer's legs;

adjustment means for adjusting the effective connecting length of the leg straps wherein the degree of restricting hyperextension of the wearer's legs when standing or walking is varied.

* * * * *